US005119751A

United States Patent [19]

Wood

[11] Patent Number: 5,119,751

[45] Date of Patent: Jun. 9, 1992

[54] VERTICAL STABILIZER INSTALLED TOWED ARRAY HANDLING SYSTEM

[75] Inventor: Edwin H. Wood, North Franklin, Conn.

[73] Assignee: The United States of America as represented by the Secretary of the Navy, Washington, D.C.

[21] Appl. No.: 617,838

[22] Filed: Nov. 23, 1990

[51] Int. Cl.[5] ..... B63R 21/04

[52] U.S. Cl. ..... 114/242; 114/254

[58] Field of Search ..... 114/242, 244, 245, 251, 114/253, 254; 242/77, 86.5 R, 86.6, 86.7, 147 R, 156

[56] References Cited

U.S. PATENT DOCUMENTS

| | | | |
|---|---|---|---|
| 3,596,070 | 7/1971 | McCool | 114/254 |
| 3,801,071 | 4/1974 | Barron | 114/254 |
| 4,349,179 | 9/1982 | Barber | 114/254 |
| 4,372,359 | 2/1983 | Hanson et al. | 114/254 |
| 4,393,803 | 7/1983 | Donalies | 114/254 |
| 4,831,599 | 5/1989 | Dragsund et al. | 114/254 |
| 4,846,090 | 7/1989 | Palmquist | 114/254 |
| 4,930,719 | 6/1990 | Sehl | 114/254 |

*Primary Examiner*—Jesus D. Sotelo
*Assistant Examiner*—Stephen P. Avila
*Attorney, Agent, or Firm*—Michael J. McGowan; Prithvi C. Lall; Michael F. Oglo

[57] ABSTRACT

A submarine has a vertical stabilizer providing a chamber in which is rotatably mounted a reel for rotation about an athwartships axis. One of the side elements of the reel has an engageable surface adjacent its periphery, and a drive motor in the stabilizer is engaged with the engageable surface of the one side element to effect rotation of the reel. An elongated cable is coiled about the hub of the reel and extends outwardly of a passage extending to the aft end of the stabilizer. A mechanism inside in the vertical stabilizer guides the cable between the passage and the storage space to facilitate coiling of the cable on to the reel and for deploying the cable therefrom. A brake mechanism is used to prevent the reel against rotation to prevent further either deploying or coiling of the cable. A driving mechanism controls the rate of deploying of the cable.

12 Claims, 2 Drawing Sheets

VERTICAL STABILIZER INSTALLED TOWED ARRAY HANDLING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to submersible vehicles, and more particularly to a stabilizer mounted cable deploying system for storing and towing instruments or other apparatus behind the moving vehicle.

Submersible vehicles frequently travel at significant depth and at relatively high speeds. For a number of applications, the submersible vehicles may tow an instrument package at a substantial distance therebehind in order to detect sounds, to conduct measurements etc., in an area of undisturbed water. The hydrodynamic drag load of the cable and instrument package, hereafter referred to as the towed body, will impose a substantial tension upon the towed body which may contain delicate signal transmission elements such as optical fibers, telemetry, etc. Accordingly, it is desirable to minimize the stresses which may be placed upon the towed body as it is deployed and retrieved into a storage position in the submersible vehicle.

In order to improve their stability, some submersible vehicles are designed with horizontal and sometimes vertical stabilizers at their aft end. The stabilizers have the effect of improving control over the attitude of the vehicle as it travels through the water. However, these stabilizers can provide a problem from the standpoint of possible interference with and damage to a towed body which is deployed from within the body of the vehicle forwardly of the stabilizer area.

It is also an object to provide such a system which may be readily provided upon submersible vehicles of the type having horizontal stabilizers, and which will not unduly affect the performance of the vehicle.

Another object is to provide such a system which may be relatively economically fabricated and which permits ready repair or replacement of the towed body and handling system operating components.

SUMMARY OF THE INVENTION

It is an object of the present invention to provide a novel towed body storage and deployment system for submersible vehicles.

It has now been found that the foregoing and related objects may be readily attained in a submarine with horizontal and vertical stabilizers. At least one vertical stabilizer provides a chamber therewithin and a passage extending inwardly from the aft end of the vertical stabilizer into this chamber. A reel is rotatably mounted in the chamber for rotation about an athwartships axis, and it has a hub element and a pair of side elements defining a storage space therebetween. One of the side elements of the reel has engageable means thereon adjacent its periphery, and drive means in the vertical stabilizer is engageable with the engageable means on the one side element to effect rotation of the reel.

A cable which is a part of the towed body is coiled about the hub in the storage space and extends outwardly of the passage, and guide means in the stabilizer guides the towed body between the passage and the storage space to facilitate coiling of the towed body on the reel and for deploying it therefrom. Also provided are releasable means for locking the reel against rotation and control means for the drive means.

Preferably, the engageable means is disposed about the circumferential edge of the one side element, and the drive means includes a motor disposed with its shaft extending parallel to the axis of rotation of the reel. Generally, the engageable means comprises gear teeth formed in the circumferential edge of the one side element and the shaft of the drive motor has a gear thereon which is engaged therewith. The guide means also controls tension on the cable to facilitate its deployment and retraction.

In its usual form, the outer side element of the reel provides a portion of the outer side surface of the vertical stabilizer, and there is included a slip ring assembly for the reel with the cable having an inner end portion extending through the hub to the slip ring assembly and another cable extending from the fixed portion of the slip ring into the horizontal stabilizer. Desirably, the vertical stabilizer has a removable access element in its periphery to provide access to the drive means.

DESCRIPTION OF THE PREFERRED EMBODIMENT

Figure 1:
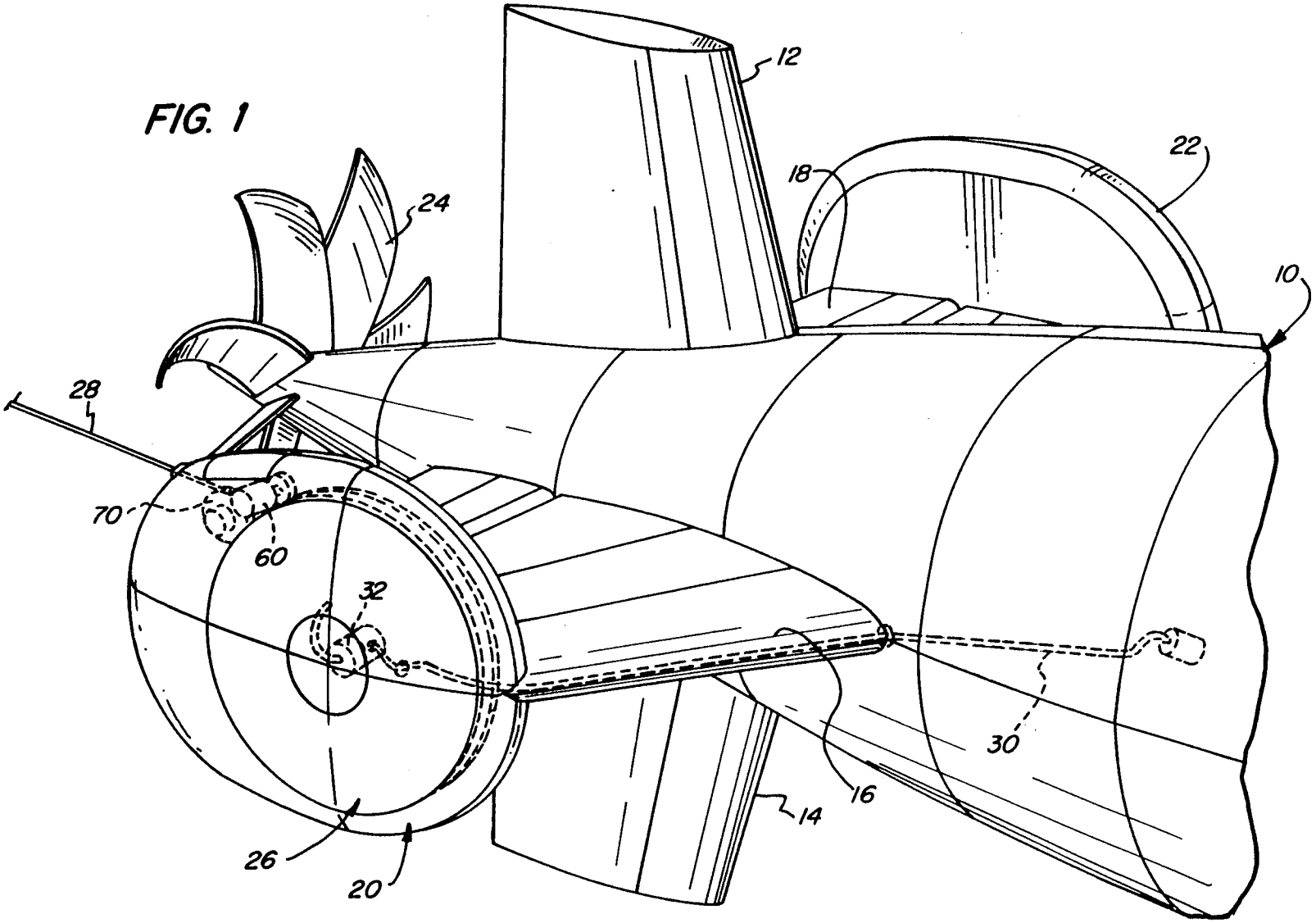
FIG. 1 is a fragmentary perspective view of a submersible vehicle employing the towed body storage and deployment assembly of the present invention.

Turning first to FIG. 1, therein fragmentarily illustrated is a submersible vehicle embodying the present invention. At the aft end of the hull which is generally designated by the numeral 10, are provided the vertical rudders 12, 14, the horizontal stabilizers 16, 18, and the outboard vertical stabilizers generally designated by the numerals 20, 22. Also illustrated at the very aft end of the hull 10 is the propeller 24.

Also illustrated in FIG. 1 is the towed body storage reel 26 for the cable of the towed body 28 extending outwardly from the aft end of the vertical stabilizer 20. Also seen is the connector cable 30 which extends from the slip ring assembly 32 into the horizontal stabilizer 16 and ultimately into the hull 10 for the connection to various instrumentation.

Figure 3:
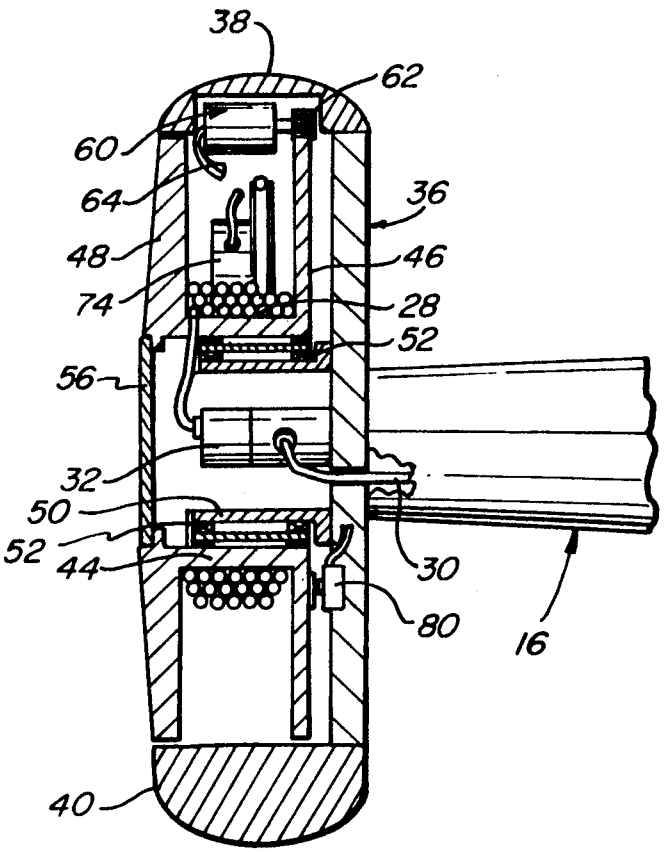
FIG. 3 is a fragmentary cross sectional view of the assembly in FIG. 3.
Figure 2:
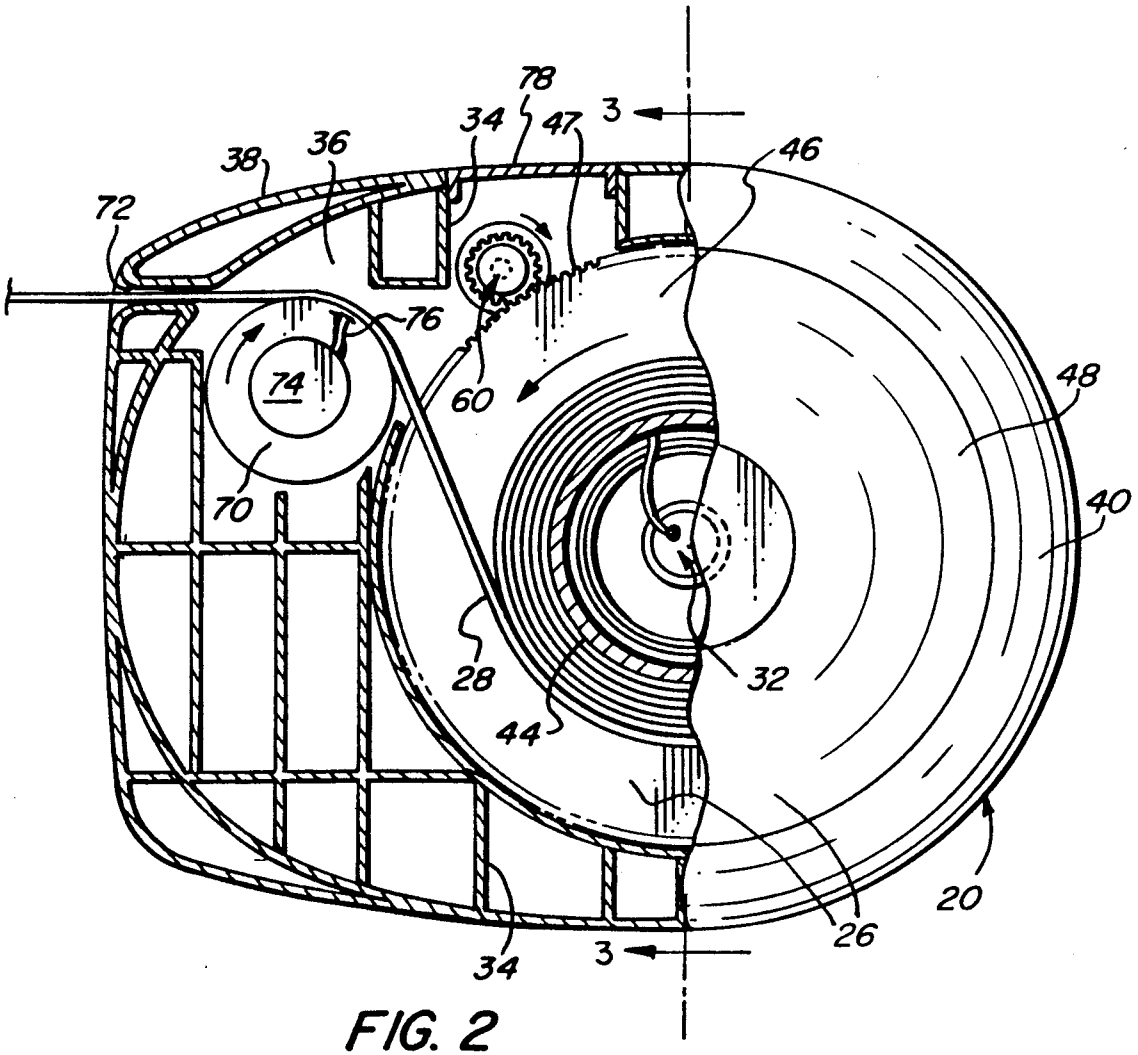
FIG. 2 is a side elevational view of the vertical stabilizer containing the assembly of the present invention with a portion broken away to reveal internal construction.

Turning now to FIGS. 2 and 3, it can be seen that the vertical stabilizer 20 has a skeleton 34 with an inboard skin 36 attached thereto and with a peripheral skin 38 extending thereabout. On its outboard side, the stabilizer 20 has a partial outboard skin 40. The skeleton 34 and the outboard skin 40 provide a circular recess for the reel 26 which rotatably seats therein. The reel itself is comprised of a hub 44, an inner flange 46, and an outer flange 48 which is configured to cooperate with the outboard skin 40 so as to provide a substantially smooth surface for the outboard side of the vertical stabilizer 20.

The hub 44 of the reel 26 is rotatably mounted upon the hub support cylinder 50 by the bearings 52 and the outer end of the hub 44 is covered by an access plate 56. As can be seen in FIG. 2, the circumference of the inner flange 46 is formed with gear teeth 47 extending thereabout.

Mounted in the upper end of the chamber provided within the vertical stabilizer 20 is a drive motor generally designated by the numeral 60 which has a drive gear 62 mounted upon its shaft and engaged with the gear teeth 56 of the reel 26 so as to effect rotation of the reel when actuated. Diagrammatically illustrated by the wire 64 is the cable providing the power and control connection to the motor 60.

As can be seen, an extended length of cable 28 is coiled within the storage area defined between the flanges 46, 48 of the reel 26, and the inner end of the towed cable 28 extends through the hub 44 and into the slip ring assembly 32. Extending from the opposite side of the slip ring assembly 32 is the signal conductor 30 which extends through the horizontal stabilizer 16 into the hull 10 for connection to the appropriate instrumentation. As will also be appreciated, the drive connection and control cable from the drive motor 60 similarly extends through the horizontal stabilizer 16 and into the hull 10.

The cable 28 extends from the storage position within the reel 26 over a traction device herein depicted as a sheave 70 which has its upper periphery aligned with the access passage 72 in the aft end of the vertical stabilizer 20. The traction device 70 is driven by a variable speed motor 74 and is powered and controlled through the cable 76 which is similarly conducted into the hull 10 through the horizontal stabilizer 16.

As seen in FIG. 2, the peripheral skin 38 for the vertical stabilizer 20 is provided with an access plate 78 to enable repair or replacement of the motor 60. A similar access plate (not shown) is provided in the outboard skin 40 to enable repair or replacement of the motor 74.

If so desired, the spacing between the elements of the skeleton 34 may be filled with a closed cell foam material to add buoyancy to increase the rigidity and ultimate strength of the horizontal stabilizer.

Diagrammatically shown in FIG. 3 is a solenoid actuated lock 80 to engage the reel 26 and prevent its rotation.

In operation of the assembly of the present invention, a command signal sent through a cable from the controls within the hull 10 will actuate the motor 60 and rotate the reel 26 to deploy the towed cable 28 the desired distance behind the vehicle. Concurrently, the solenoid 80 is actuated to release the locking action upon the reel 26. Measuring and other control elements (not shown) may be included within the assembly to monitor the length of towed cable 28 which is being deployed.

Concurrently, the motor 74 causes the traction device 70 to rotate at an adjustable rate to maintain a desired level of tension on the towed cable 28 as it is being fed outwardly from the reel 26 through the access passage 72. As will be appreciated, its rotation in the counter-clockwise direction facilitates deployment of the towed cable 28, and in the clockwise direction facilitates its retrieval. After the desired length of towed body 28 has been deployed, the motor 60 is stopped and the solenoid 80 is actuated to lock the reel 26. When it is desired to retract the towed cable 28, the solenoid 80 is actuated to unlock the reel 26 for rotation, and the direction of rotation of the motor 60 is altered by a control signal to effect rotation of the motor 60 and the gear 62 in the opposite or counter-clockwise direction as shown by the arrow in FIG. 2. Similarly, a control signal to actuate the motor 74 drives the traction device 70 at a controlled rate or controlled torque. As a result, the reel 26 will be rotated in a counter-clockwise direction as shown in the drawing to coil 28 within the storage space between the flanges 46, 48 of the reel 26. It is to be noted that a towed body will be attached to the outside end of cable 28.

Generally, lengths of 1,000–5,000 feet may be required for some applications: accordingly, it is generally desirable to minimize towed body diameter in order to ensure sufficient capacity on the reel. If necessary, multiple reels may be employed within a single vertical stabilizer by increasing the width of the chamber therewithin or reducing the width of the reels and providing separate and serially actuated drive systems for the reels.

The motor for driving the reel should be reversible and desirably has a rating of 2–10 horsepower. It should be encapsulated so that it will not be adversely affected by the water environment which surrounds it.

Similarly, the motor which is utilized to control the rotation of the traction device to maintain a desired level of tension and facilitate the movement of the cable should have a rating of 2–10 horsepower and is also reversible.

In the illustrated embodiment, the lock for the reel is shown as a solenoid actuated with a plunger which enqages in a suitable stop recesses in the side surface of the inner flange of the reel. However, other types of locking mechanisms may be employed. Moreover, although less desirable, the motor itself may be utilized to provide the braking action for the reel.

The reel is conveniently fabricated from metal components although synthetic resins may also be employed. The stabilizer is desirably fabricated by providing a skeletal metal framework to which the skins are welded or otherwise secured. The skeletal structure of the framework can be filled with a closed cell foam material to provide buoyancy and to improve the rigidity of the assembly if so desired.

As will also be appreciated, the cable assemblies of the present invention may be employed in both of the vertical stabilizers of the vehicle to enable towing of multiple arrays.

In the illustrated embodiment, the vertical stabilizer assembly of the present invention provides access to the several motors and to the slip ring assembly as well as to the reel itself in order to facilitate repair and replacement without requiring total disassembly of the structure.

As will be readily appreciated, the design of the assembly of the present invention enables the cable to be deployed and retracted in an efficient manner while minimizing stresses upon the cable through the control afforded by the drive motor for the reel and the control provided by the traction device.

Thus, it can be seen from the foregoing detailed description and attached drawings that the towed body handling system assembly of the present invention is one which may be readily employed in connection with submersible vehicles of the type having horizontal stabilizers. Its components may be readily fabricated and assembled within the vertical stabilizer, and they may be readily serviced during the useful life of the assembly. The cable is deployed and retracted in a manner which minimizes unnecessary stress upon the towed body so as to reduce the potential for fracture of the towed body or of its internal components.

What is claimed is;

1. In a submarine having a plurality of horizontal stabilizers, a vertical stabilizer towed array handling system combination comprising:

a vertical stabilizer secured to one of said plurality of horizontal stabilizers and providing a chamber therewithin, said stabilizer having a passage extending inwardly from an aft end thereof into said chamber;

a reel rotatably mounted in said chamber for rotation about an athwartships axis, said reel having a hub element and a pair of side elements defining a storage space therebetween, one of said side elements having engageable means thereon adjacent its periphery;

drive means in said vertical stabilizer engageable with said engageable means of said one side element to effect rotation of said reel;

an elongated cable coiled about said hub in said storage space and extending outwardly of said passage;

guide means in said stabilizer for guiding said cable between said passage and said storage space to facilitate coiling said cable onto said reel and for deploying it therefrom;

releasable means for locking said reel against rotation; and control means for said drive means.

2. The combination in accordance with claim 1 wherein said engageable means is disposed about a circumferential edge of said one side element.

3. The combination in accordance with claim 2 wherein said drive means includes a motor disposed with its shaft extending parallel to an axis of rotation of said reel.

4. The combination in accordance with claim 3 wherein said engageable means comprises gear teeth formed in the circumferential edge of said one side element and the shaft of said drive motor has a gear thereon which is engaged therewith.

5. The combination in accordance with claim 1 wherein an outer side element of said reel provides a portion of the outer side surface of said vertical stabilizer.

6. The combination in accordance with claim 1 wherein there is included a slip ring assembly for said reel and said cable has an inner end portion extending through said hub and into said slip ring assembly.

7. The combination in accordance with claim 1 wherein said vertical stabilizer has a removable access element in its periphery to provide access to said drive means.

8. The combination in accordance with claim 1 wherein said guide means controls tension on said cable to facilitate deployment and coiling of said cable.

9. In a submarine having a plurality of horizontal stabilizers, a vertical stabilizer towed array system combination comprising:

a vertical stabilizer secured to one of said plurality of horizontal stabilizers and providing a chamber therewithin, said stabilizer having a passage extending inwardly from an aft end of said vertical stabilizer into said chamber;

a reel rotatably mounted in said chamber for rotation about an athwartships axis, said reel having a hub element and a pair of side elements defining a storage space therebetween, one of said side elements having engageable means thereon disposed about a circumferential edge of one of said side elements, an outer side element of said reel providing a portion of an outer side surface of said vertical stabilizer;

drive means in said vertical stabilizer engageable with said engageable means of said one side element to effect rotation of said reel, said drive means including a motor disposed with its shaft extending parallel to an axis of rotation or said reel;

an elongated cable coiled about said hub in said storage space and extending outwardly of said passage;

guide means in said stabilizer for guiding said cable between said passage and said storage space to facilitate coiling said cable onto said reel and for deploying it therefrom;

releasable means for locking said reel against rotation; and control means for said drive means.

10. The submarine in accordance with claim 9 wherein said engageable means comprises gear teeth formed in the circumferential edge of said one side element and the shaft of said drive motor has a gear thereon which is engaged therewith.

11. The submarine in accordance with claim 9 wherein there is included a slip ring assembly for said reel and said cable has an inner end portion extending through said hub into said slip ring assembly.

12. The submarine in accordance with claim 9 wherein said vertical stabilizer has a removable access element in its periphery to provide access to said drive means.

* * * * *